US008967405B2

(12) United States Patent
Morrone

(10) Patent No.: US 8,967,405 B2
(45) Date of Patent: Mar. 3, 2015

(54) VENTING BABY BOTTLE

(75) Inventor: Joseph Morrone, Wakefield, RI (US)

(73) Assignee: Light Bulb Inventions, LLC, Wakefield, RI (US)

( * ) Notice: Subject to any disclaimer, the term of this patent is extended or adjusted under 35 U.S.C. 154(b) by 635 days.

(21) Appl. No.: 13/223,177

(22) Filed: Aug. 31, 2011

(65) Prior Publication Data

US 2013/0048591 A1 Feb. 28, 2013

(51) Int. Cl.
*A61J 9/04* (2006.01)
*A61J 9/00* (2006.01)

(52) U.S. Cl.
CPC .... *A61J 9/04* (2013.01); *A61J 9/001* (2013.01)
USPC ..... 215/11.5; 215/11.6

(58) Field of Classification Search
CPC ..... A61J 9/04; A61J 9/001; A61J 9/003; A61J 9/006
USPC ..... 215/11.5, 11.1, 11.4, 11.6, 341, 228; 248/102, 104, 105; 206/217
See application file for complete search history.

(56) References Cited

U.S. PATENT DOCUMENTS

| | | | |
|---|---|---|---|
| 189,691 | A | 4/1877 | Briere |
| 345,518 | A | 7/1886 | Lelievre |
| 598,231 | A | 2/1898 | Roderick |
| 834,014 | A | 10/1906 | Lyke |
| 927,013 | A | 7/1909 | Van Cleave |
| 979,607 | A | 12/1910 | Van Cleave |
| 1,441,623 | A | 1/1923 | Davenport |
| 2,156,313 | A | 1/1936 | Schwab |
| 2,061,477 | A | 11/1936 | Perry |
| 2,239,275 | A | 4/1941 | Schwab |
| 2,610,755 | A | 9/1952 | Gits |
| 2,742,168 | A | 4/1956 | Panetti |
| 2,744,646 | A | 5/1956 | Blackstone |
| 3,059,797 | A | 10/1962 | Wilkinson et al. |
| 3,254,809 | A | 6/1966 | Breneman |
| 5,054,660 | A | 10/1991 | Sherman et al. |
| 5,269,444 | A | 12/1993 | Wright |
| 5,449,098 | A | 9/1995 | Offman |

(Continued)

FOREIGN PATENT DOCUMENTS

| | | |
|---|---|---|
| DE | 261605 | 11/1912 |
| GB | 273185 | 6/1927 |

(Continued)

OTHER PUBLICATIONS

International Search Report and Written Opinion for PCT/US2012/053266, Aug. 31, 2012, Morrone, Joseph A.

*Primary Examiner* — Robert J Hicks
*Assistant Examiner* — Kareen Rush
(74) *Attorney, Agent, or Firm* — Antoinette G. Giugliano; AGG Intellectual Property Law

(57) ABSTRACT

The present invention relates to a venting baby bottle that includes an outer container, and an inner container, adapted to fit within the outer container, wherein the inner container has a base, a tapered neck, and a vent tube projecting upwardly into the inner container. The baby bottle of the present invention also includes a gasket having a gasket base adapted to fit the neck of the inner container, one or more gasket channels, and a lip. A reservoir is defined between the neck of the inner container and the wall of the outer container. The venting baby bottle of the present invention has an air passage, when inverted and filled with liquid, from a point outside the baby bottle to a point inside the inner container.

13 Claims, 10 Drawing Sheets

(56) References Cited

U.S. PATENT DOCUMENTS

| | | | | |
|---|---|---|---|---|
| 5,570,796 | A | 11/1996 | Brown et al. | |
| 5,779,071 | A | 7/1998 | Brown et al. | |
| 6,499,615 | B1 * | 12/2002 | Szieff et al. | 215/11.5 |
| 7,984,818 | B1 * | 7/2011 | Fucito | 215/11.5 |
| 2009/0200257 | A1 | 8/2009 | McKendry et al. | |
| 2010/0181277 | A1 * | 7/2010 | Brown et al. | 215/11.5 |
| 2011/0068078 | A1 | 3/2011 | Brown et al. | |
| 2011/0155684 | A1 * | 6/2011 | Sirota | 215/11.5 |
| 2012/0012550 | A1 * | 1/2012 | Boonprasop | 215/11.4 |

FOREIGN PATENT DOCUMENTS

| | | |
|---|---|---|
| GB | 454053 | 9/1936 |
| SE | 8200147 | 1/1982 |
| WO | WO 2005/112869 | 12/2005 |

* cited by examiner

VENTING BABY BOTTLE

BACKGROUND OF THE INVENTION

Traditional baby bottles often did not have any venting means and, as a result, a vacuum can form inside the bottle during use. This vacuum caused air bubbles to form within the liquid (e.g., formula, milk, etc) being ingested by the infant. Ingestion of air bubbles by infants is believed to cause stomach aches, gas or colic.

Vented baby bottles were developed to solve this problem and exist with various designs. However, some designs are flawed. For example, certain venting baby bottles leak through the passages that were designed to allow for the air venting. Others are known to be difficult to clean.

Accordingly, a need exists for a venting baby bottle that allows for air exchange to prevent a vacuum from forming during use of the bottle. Another need exists for a venting baby bottle that does not leak. A further need exists for a venting baby bottle that is easy to clean.

SUMMARY OF THE INVENTION

The present invention relates to a venting baby bottle that has an outer container, and inner container and a gasket. The outer container has an open top, one or more side channels, wherein the open top is adapted to receive a cap. The inner container is adapted to fit within the outer container, and has a base, a tapered neck, and a vent means at the base of the inner container. The gasket includes a gasket base adapted to fit the neck of the inner container, one or more gasket channels, and a lip. When the inner container is placed within the outer container, a reservoir is defined between the neck of the inner container and the outer container. In an aspect, the volume of the side channels is less than the volume of the reservoir. The vent means can be, for example, a vent tube having an opened end that extending upwardly into the inner container. The baby bottle of the present invention also includes a cap adapted to receive a nipple and having one or more vent openings. When having liquid therein and inverted and in use, an air passage is established from air outside the baby bottle to a point inside of the inner container (e.g., from a point outside the venting baby bottle, through one or more vent openings in the cap, through the gasket channel, through a space between the inner container and the outer container, and to a point inside the inner container). The baby bottle of the present invention can further include indicia to indicate a point to which the venting baby bottle is filled with a liquid, and the indicia is placed on the outer container, inner container when the outer container is transparent or translucent, or both.

In another embodiment, the venting baby bottle includes an outer container having an open top, wherein the open top is adapted to receive a cap; an inner container, adapted to fit within the outer container, wherein the inner container has a base, a tapered neck, and a vent tube projecting upwardly into the inner container; and a gasket having a gasket base adapted to fit the neck of the inner container, one or more gasket channels, and a lip. When the inner container is placed within the outer container, a reservoir is defined between the neck of the inner container and the outer container, and an inter-container space is defined between the outside surface of the base of the inner container and inside surface of the outer container.

In yet another embodiment, the present invention pertains to a venting baby bottle having a reservoir, a means for preventing the liquid from leaking from the cap and a means for venting air from a point outside of the venting baby bottle to a point within the reservoir. The reservoir is defined by a neck of a inner container positioned within an outer container. The inner container includes a base with an outer surface, a vent means, and the neck. The outer container has a cylindrical wall with an inner surface, a bottom, and an open top adapted to receive a cap. The inner container and the outer container are adapted to have an inter-container space between the outer surface of the inner container base and inner surface of the outer container. The reservoir volume is greater than the inter-container volume. When the venting baby bottle is in an inverted position, in use and has liquid therein, the vent means provides for venting from the inter-container space to a point in the interior of the inner container. An air passage is established and communicates from a point outside of the venting baby bottle to a point in the interior of the inner container. In an aspect, the means for preventing the liquid from leaking from the cap and the means for venting air from a point within the reservoir is a gasket having a lip and one or more gasket channels.

The present invent further relates to a venting baby bottle system. The system has one or more of the following items, which are further described herein: an outer container, an inner container, a gasket, a cap, and a baby bottle nipple. The system can further include accessories used to clean the baby bottle system.

The present invention includes methods for using the venting baby bottle described herein. The steps of the method include placing liquid therein; and allowing an infant to suck from the bottle in an inverted position, thereby establishing an air passage between the air outside of the venting baby bottle and a point inside the inner container. During use, air from the outside of the baby bottle displaces liquid consumed by an infant during use.

The venting baby bottle of the present invention has numerous advantages. The baby bottle allows for venting of air to prevent a vacuum from building up within the bottle during use, thereby preventing the ingestion of air bubbles by the infant using the bottle. The baby bottle allows for venting while at the same time prevents leaks from the cap of the bottle. Additionally, the design of the baby bottle allows the bottle and all of its parts to be easily cleaned and/or sterilized. Yet another advantage of the design of the baby bottle of the present invention is that the pieces fit easily together making it easy for the user to assemble and disassemble.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

The present invention relates to a baby bottle that has a unique design to allow air to vent to the outside of the bottle. The design of the vented baby bottle includes an inner container that resides within an outer container, and has a specially designed gasket that allows for venting but also prevents leaks.

Figure 1:
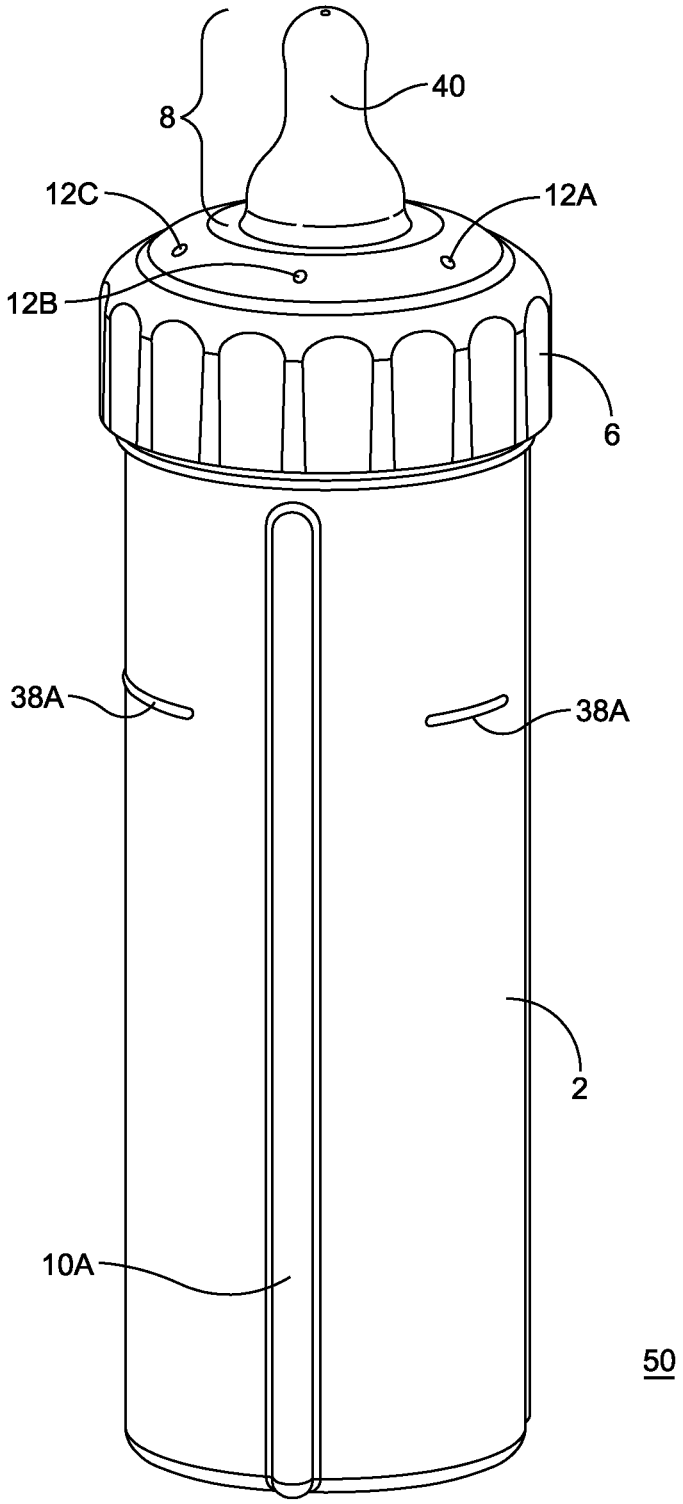
FIG. 1 is a schematic of a side view of the venting baby bottle of the present invention.

FIG. 1 shows a side view of the venting baby bottle of the present invention. The baby bottle includes outer container 2, inner container (not shown), gasket (not shown), bottle cap 6 with vent openings 12A-C (vent openings 12D-12F not shown), and nipple 8 having nipple tip 40. The outer container is made to receive the inner container. The diameter of the outer container is slightly larger than the diameter of the base of the inner container, as described in more detailed herein. The outer container, together with the inner container, is adapted such that they can be filled with liquid to be consumed by an infant. The outer container has a volume that can hold between about 3 ounces to about 14 ounces of liquid (e.g., between about 8 and about 12 ounces). The desired liquid utilized in the bottle includes, for example, formula, milk, juice, water and any other liquid suitable for an infant.

Outer container 2 further includes fill lines 38A and 38B. The outer container can include any indication that allows the user to ascertain up to which point the baby bottle should be filled. The indicia to indicate the point at which the bottle should be filled includes lines, markings, symbols, words, and the like. In the case in which the outer container is transparent, such indicia can be placed on the inner container. Additionally, the inner or outer container can be shaped to indicate the point to which the bottle should be filled. For example, as described in more detail, the inner container has a neck that tapers and the beginning of the tapering of the neck is an indication of the point to which the bottle can be filled. Indicia of the fill line are present to allow for the bottle to be filled to a proper volume. The volume of the liquid impacts the establishment of an air passage. In the case in which the venting baby bottle of the present invention is overfilled, then an air passage, under certain circumstances, could be prevented from begin established. In an aspect, the venting baby bottle includes an indicia signifying the point to which the bottle is filled.

Figure 2:
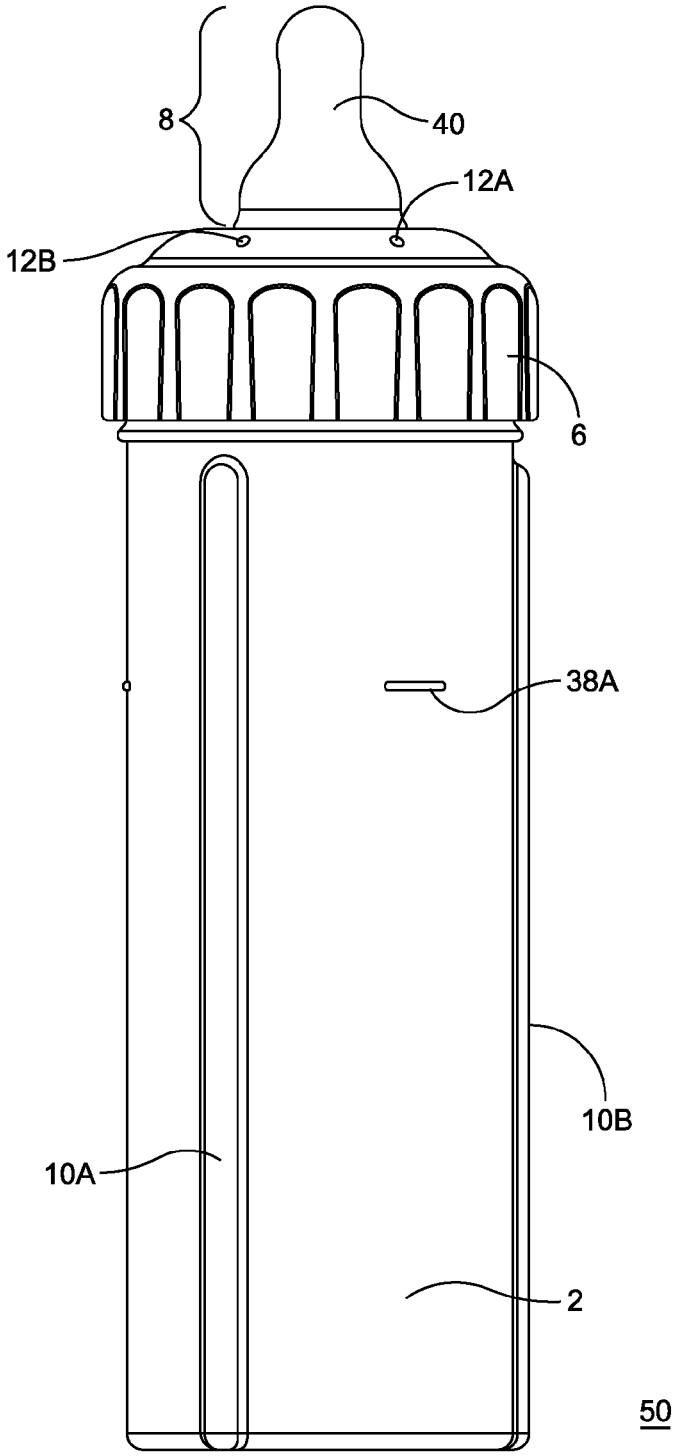
FIG. 2 is a schematic of another view of the venting baby bottle of the present invention.

Referring to FIG. 2, the outer container further includes side channels, including side channels 10A and 10B (side channel 10C now shown), running along the side of outer container 2. The channels are a trough with essentially a U-shaped cross-section. The channels begin at a point at or near the bottom of the outer container and run to a point at or near the reservoir formed when the inner container is placed within the outer container, which is further described herein. In this embodiment, there are three side channels. The channels can be of any shape or size to facilitate the establishment of an air passage when the venting baby bottle of the present invention is in use, and inverted. The channel can begin at any point at or near the bottom of the outer container so long as one of the channels communicates with the vent tube in the inner container. The channel can continue to any point so long as the channel communicates with air in the reservoir. When the baby bottle is upright, the channels are shown in the figures to run in a vertical fashion. However, the channels of the bottle of the present invention can run in any direction (e.g., angled, curved, and the like) so long as the channel communicates with the vent tube of the inner container and the air inside the reservoir. The channel can have a cross-section that is "U" shaped, but can also be "V" shaped, "C" shaped, an irregular shaped, or any shape.

One or more channels can be present. Although there are three channels in the embodiment shown in the figures, any number of channels can be used (between about 2 and about 20 channels). In an embodiment, several channels are used so that when the bottle is inverted (inverted position shown in FIG. 10), an air passage is established somewhere in the bottle. In this instance, a channel can be filled with liquid on one side, while another channel is used to establish an air passage.

Figure 3:
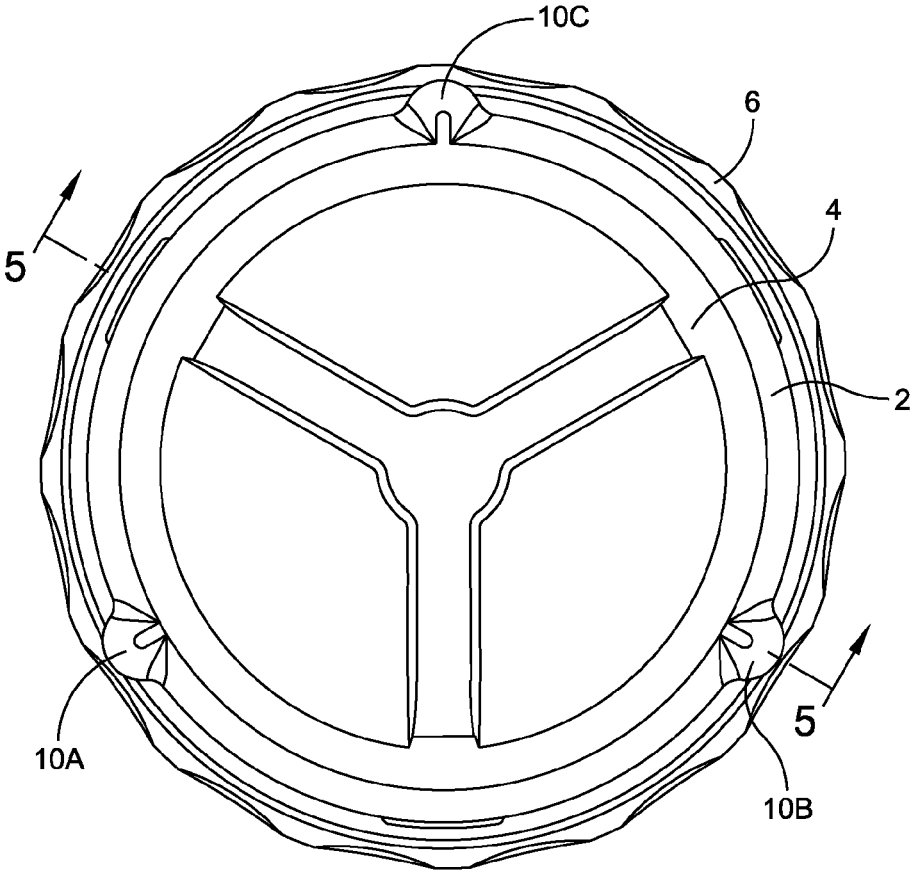
FIG. 3 is a schematic of a bottom view of the venting baby bottle of the present invention.

FIG. 3 provides a schematic from the bottom view showing channels 10A-10C, providing an air space between the outer surface of inner container 4 and the inner surface of outer container 2.

However, in an embodiment, side channels are not necessary for creating an air space between the inner and outer containers. An air passage can also be established in the space between the inner container and the outer container. This is referred to herein as the "inter-container" space. When the inner container is placed within the outer container, the inner and outer containers can adapted and fit such that a space exists between them. In this case, the inter-container space is defined herein as a "channel" through which an air passage is established when the bottle is inverted.

Figure 4:
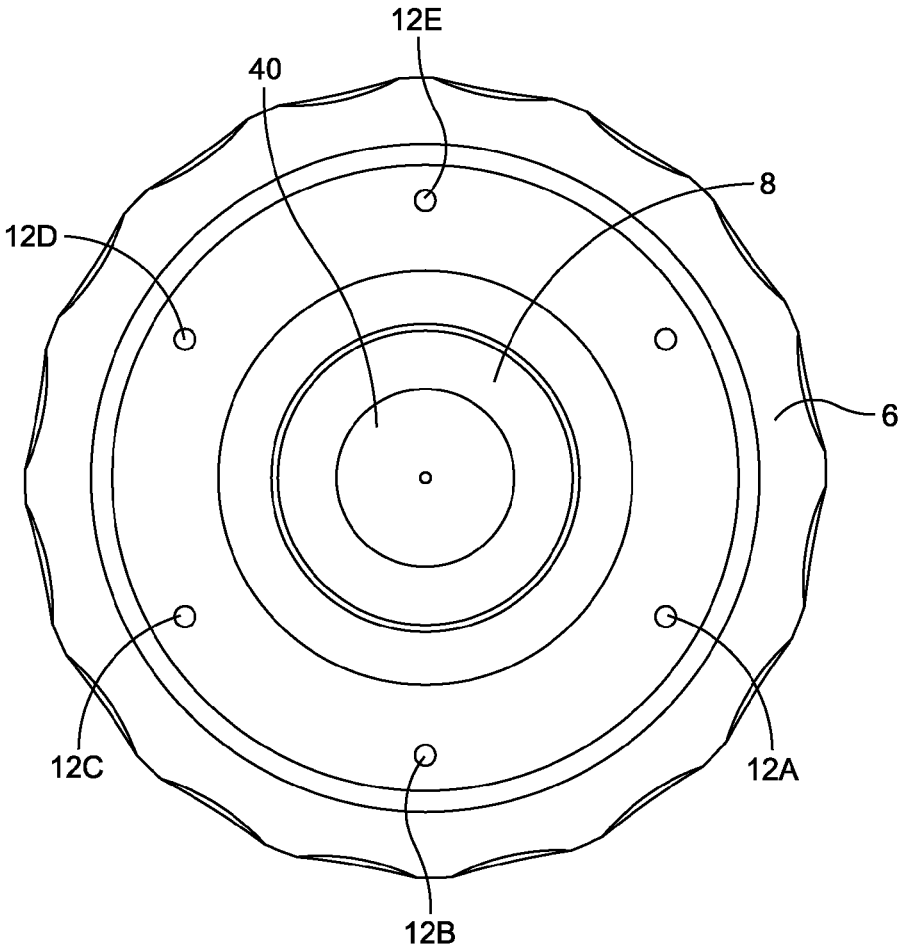
FIG. 4 is a schematic of a top view of the venting baby bottle of the present invention.

The outer container has a top opening adapted to receive a cap. FIG. 4 shows cap 6 with a plurality of vent openings, 12A-12F. The embodiment shown in FIG. 4 includes 6 vent openings. One or more vent openings can be included to establish an air passage when the bottle is inverted. In an embodiment, the vent openings are located in more than one location on the top of the cap such that an air passage can be established and that they are exposed to air regardless of the position or rotation of the bottle. Alternatively, a single opening can be used so long as an air passage is established, for example, with the use of a second gasket or modified nipple.

The cap has a center opening to receive nipple 8 having nipple base (not shown) and nipple tip 40. The center opening has a size and shape to accommodate nipple base 28. See FIG. 5 and FIG. 7. Nipple base 28 abuts the inner surface of the cap and nipple tip 40 passes through the center opening of the cap.

The cap can be adapted in several ways in order to be secured to the outer container. In this embodiment, shown in FIGS. 5 and 7, the inner surface of the cap has threads 18 that complement and threads 16 on the outer surface of the outer container, allowing the cap to be screwed onto the outer container. The cap can be secured to the outer container in any number of ways, e.g., using a latch or locking mechanism, and the like. The cap can be secured to the bottle in any way known in the art or developed in the future.

Figure 5:
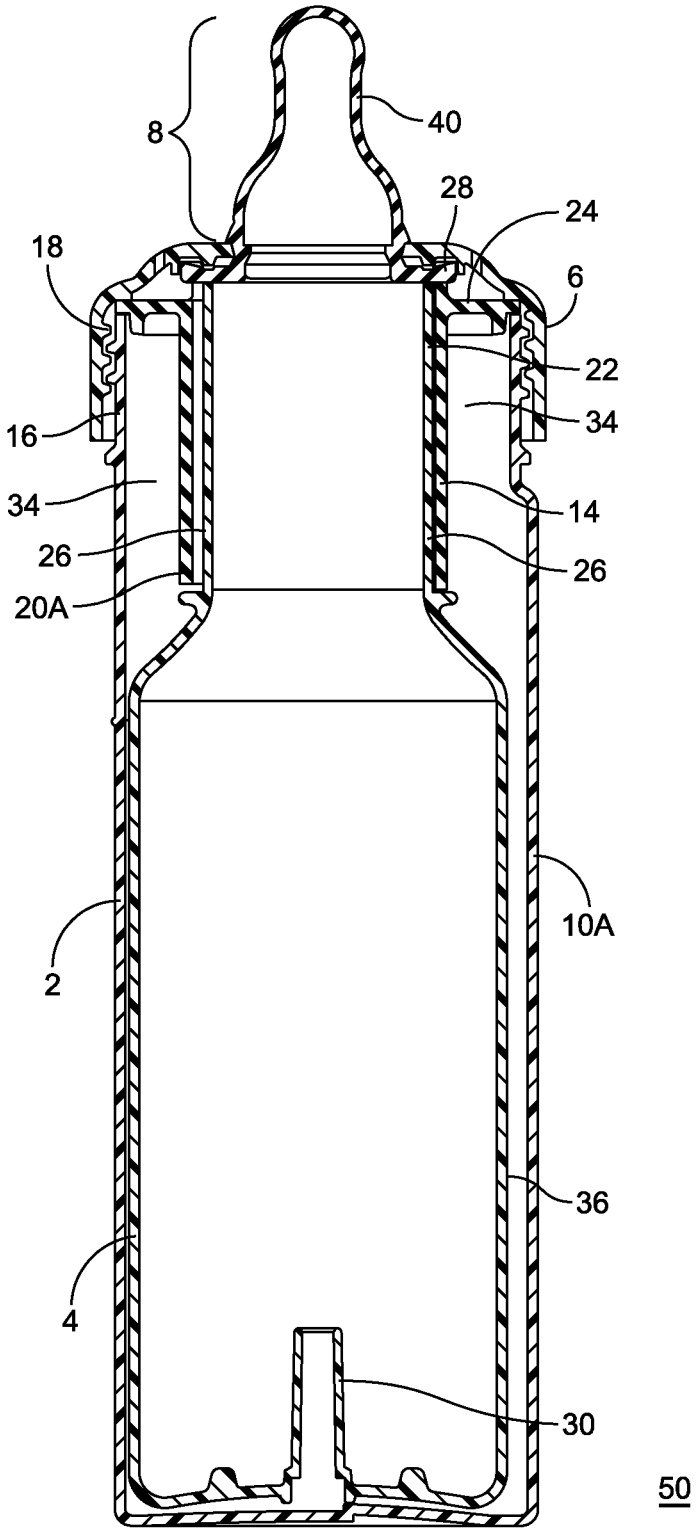
FIG. 5 is a schematic of a cross sectional view of the venting baby bottle of the present invention.

FIG. 5, a cross-section, shows inner container 4 fit within outer container 2. Inner container 4 has base 36 which tapers to neck 26, and vent tube 30. The inner container is adapted to fit within the outer container. More specifically, the diameter of the cylindrical base of the inner container is slightly less than the diameter of the cylindrical outer container such that the inner container slides into the outer container. The diameter of each can be adjusted to create an air space between the bottles to allow for venting. Side channels in the outer container can be used in addition to providing additional air space between the bottles. Through experimentation with various designs of the venting baby bottle of the present invention, only a minimal space between the inner and outer containers is needed to establish an air passage and allow liquid to flow. The space inter-container space, in an embodiment, ranges from about 0.5 mm to about 2 mm. Although the base of the inner container and the outer container are cylindrical, as a container, they can be any shape, e.g., an irregular shape, so long as the inner container fits into the outer container. In fact, in an embodiment in which channels are used, the channels can be molded to also form a grip.

Inner container 4 further includes a tapered neck. The tapering of the neck begins at or near the plane of fill lines 38A and 38B. The tapering of the neck can begin at any point so long as the volume of the reservoir is maintained to be greater than the volume of the volume of the inter-container space up to the fill line.

When the inner container is placed within the outer container, reservoir 34 is created. The reservoir is the space defined between the two bottles above the fill line. In particular, the reservoir is defined by the inner surface of the outer container wall above the fill line, the bottom surface of gasket lip 24, to the outer surface of gasket base 22. The volume of the reservoir is greater than the volume of the space between the bottles including the channels below the fill line. The shape of the reservoir is essentially cylindrical, generally surrounding the neck of the inner container, with a tapered tip. The reservoir aids in establishing an air passage when in inverted. The establishment of the air passage is further described herein.

Figure 6:
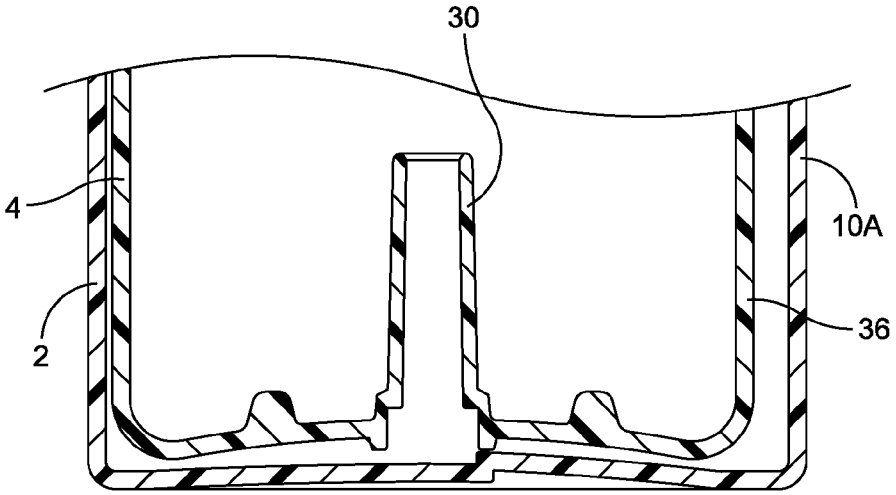
FIG. 6 is a schematic of a detailed view of a cross section of the bottom of the venting baby bottle of the present invention.
Figure 10:
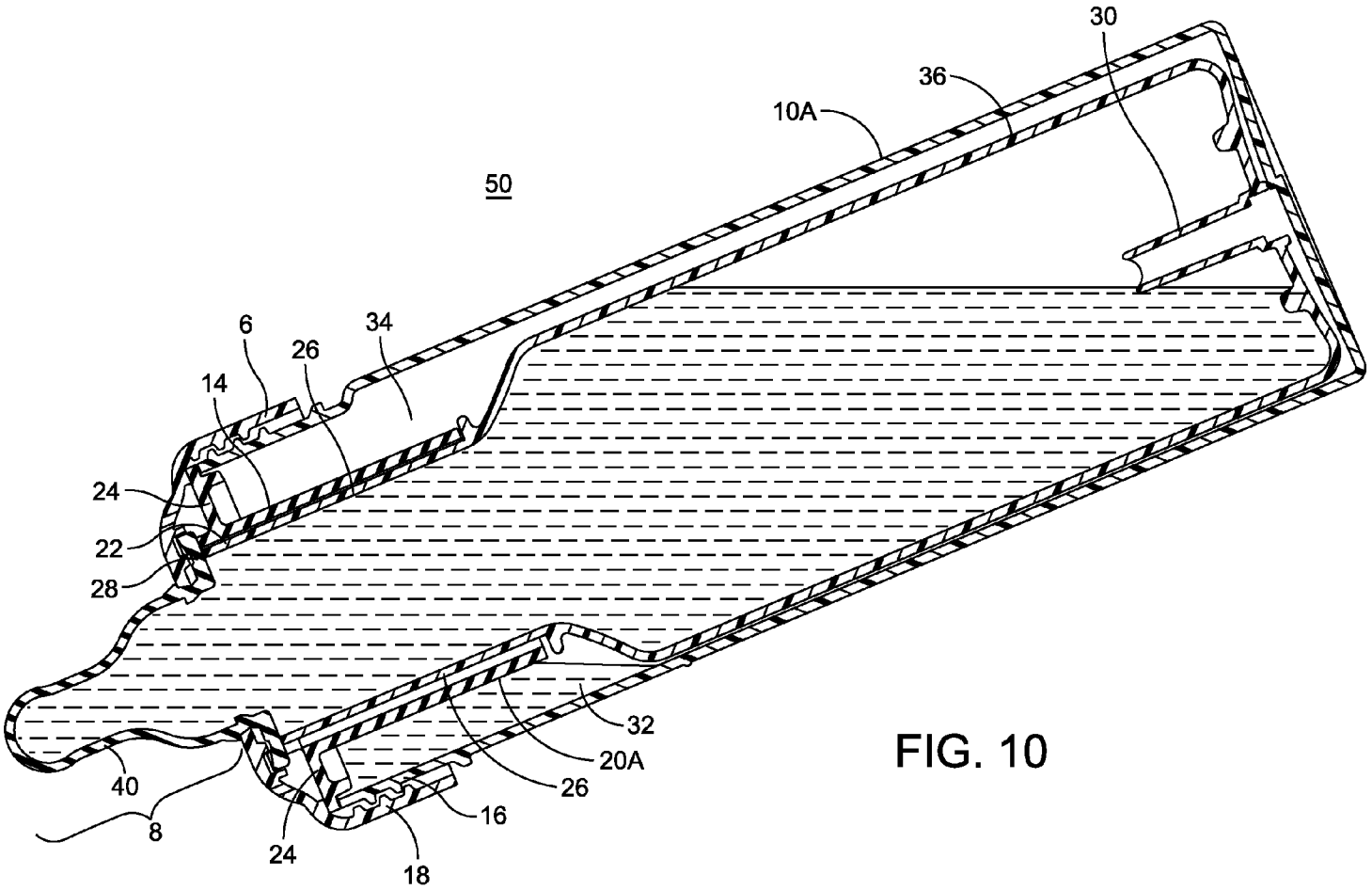
FIG. 10 is a schematic of a cross sectional view of the venting baby bottle of the present invention with liquid therein filled to the fill line in an inverted position.

FIG. 6 also shows vent tube 30 that extends upwardly to a point inside the inner container 4. The vent means provides a structure for establishing an air passage to a point inside the inner container, when the bottle is in an inverted position (See FIG. 10). In this case, the vent means is a vent tube. As shown in FIG. 10, the vent tube extends to a point inside the inner container. The vent tube can have a length such that functions as a "lock" to maintain fluid in the inner container when the bottle is not in use. The length of the vent tube depends on the length and volume of the bottle. For example, the length of the vent tube can range between about ¼ inch to about 1½ inches. The vent tube can be rigid, as shown in the figures, or a flexible tube.

When the bottle is filled with fluid, the vent tube of the present invention acts to maintain liquid inside the inner container when it is not being used (e.g., when the infant is not sucking on the bottle). When not in use but filled with fluid, the vent tube acts as a one-way lock and prevents fluid from going in and out of the inner container, and is held in by the vacuum created in the inner container. During use when liquid is being consumed, air, through the air passage, comes from outside the bottle to replace the liquid volume being lost in the inner container.

Any vent means at the bottom of the inner container can be used so long as the vent means communicate with the inter-container space when the bottle is inverted and air displaces the liquid volume being lost when in use by an infant. The vent means extends into the inner container and has an opening through which air and/or fluid can pass.

The inner and outer containers, and portions thereof (e.g., the neck, the base, the vent tube, the threads, etc), can be made from any material suitable for a baby bottle. The material used to make the baby bottle is preferably a moldable material that is safe for an infant. Examples of materials include glass, plastics, ceramic, stainless steel, polypropylene, polyactide and the like. Any material known in the art or developed in the future can be used so long as the material is suitable for making a baby bottle. Materials that are suitable for making a baby bottle include those that are moldable, do not leach unsafe chemicals such as BPA therefrom, and can be cleaned and/or sterilized. The material used for the inner container and/or the outer container can be transparent, translucent, colored or a combination thereof.

In an embodiment, the inner and outer containers can be manufactured using blow molding process. Briefly, blow molding is a manufacturing process by which hollow plastic or glass parts are formed with injection blow molding (IBM) techniques known in the art. In the IBM process, the polymer is injection molded onto a core pin, and then the core pin is rotated to a blow molding station to be inflated and cooled. The injection molding machine supplies melted polymer to the mold, and the heated polymer is inflated against the mold walls to form the shape of the inner and/or outer containers. Techniques known in the art or later developed can be used to make the inner and/or outer containers that are described herein.

Figure 7:
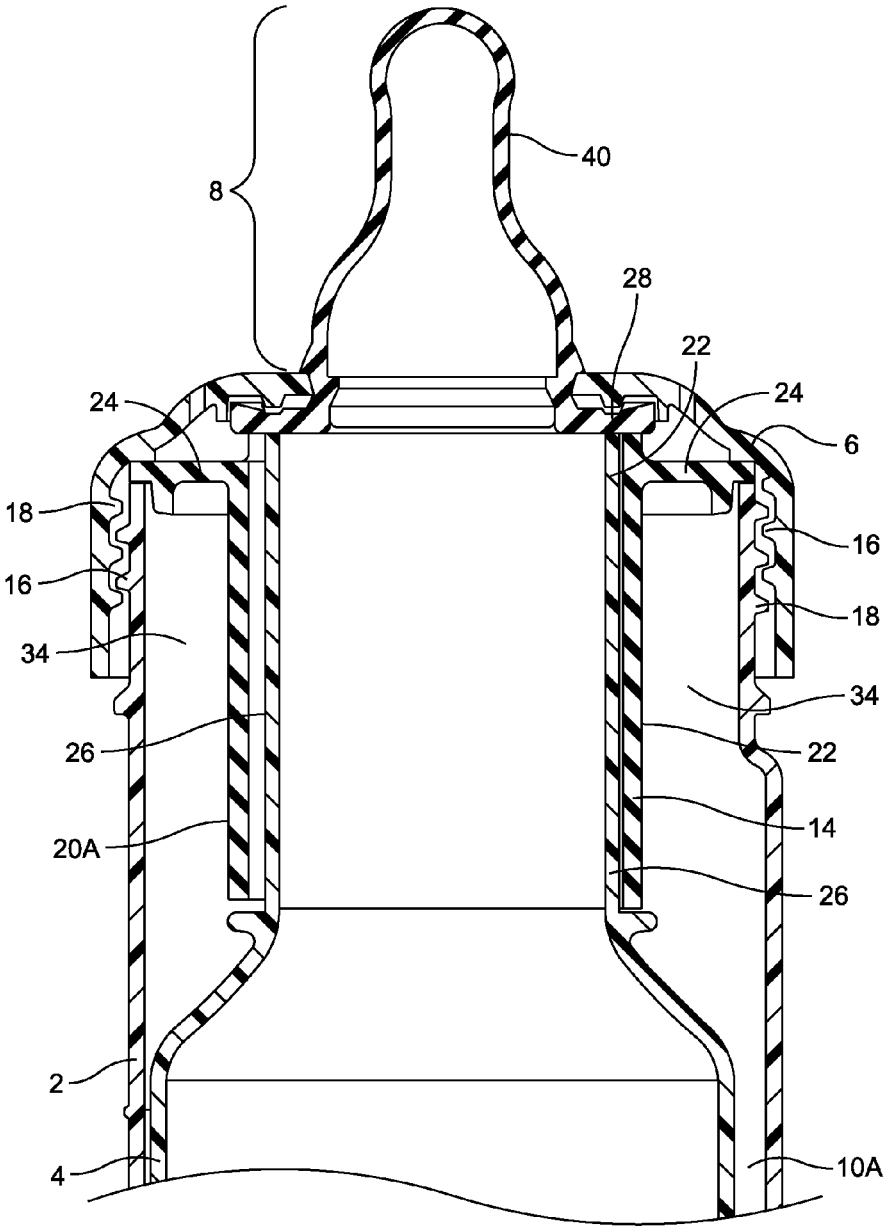
FIG. 7 is a schematic of a detailed view of a cross section of the top of the venting baby bottle of the present invention
Figure 8:
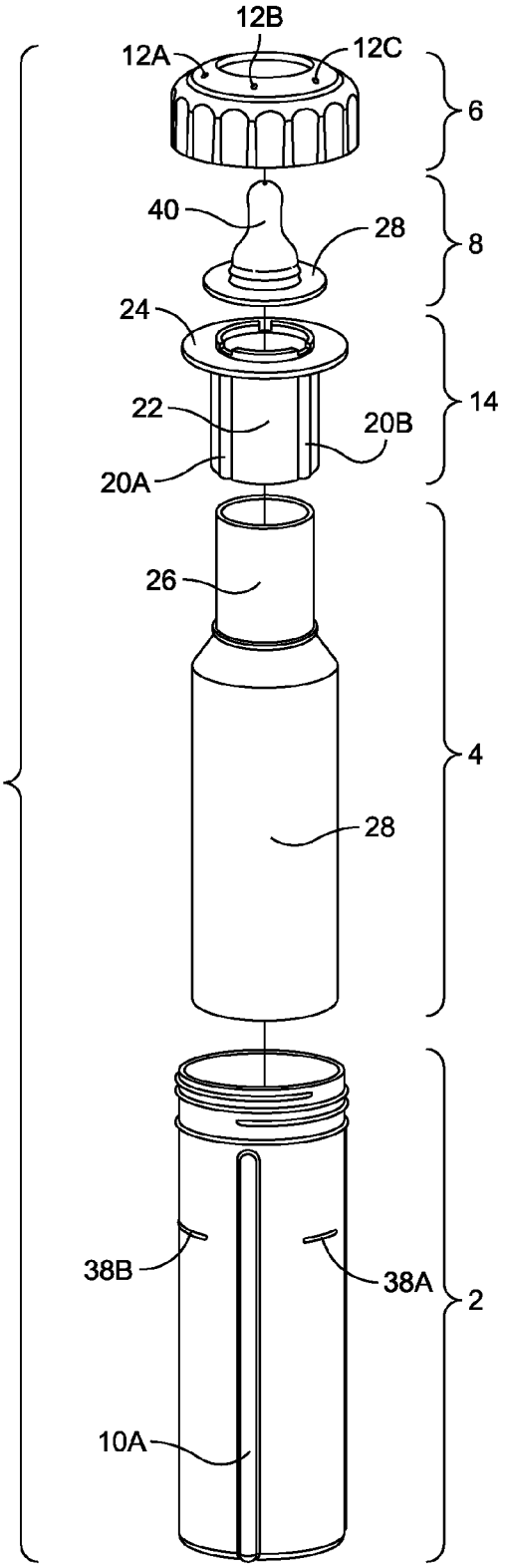
FIG. 8 is a schematic of the pieces of the venting baby bottle of the present invention and their relationship to fit one another.

Gasket 14 is shown in FIG. 7 in a cross sectional view and shown in FIG. 8 in a perspective view. Gasket 14 has gasket base 22, gasket lip 24, and gasket channels such as gasket channel 20A and 20B. See FIG. 8. The gasket has a dual function. The gasket is a means to provide an air passage between the air space inside the reservoir and the vent openings in the cap. The gasket also functions as a seal to prevent leaks and is considered a means for preventing liquid from leaking from the cap. In particular, the gasket lip provides a seal between this air passage established in part by the gasket channels and the bottom of the cap Gasket base 22 is essentially cylindrical in shape and is adapted to fit around the neck of inner container 4. Within the gasket base, one or more gasket channels exist and run along its length. Like the side channels, these channels form a trough with essentially a U-shaped cross section. The gasket channels begin at a point at or near the bottom of the neck of the inner container and run to a point at or near the bottom surface of the cap. In particular, the gasket channels begin at a point inside the reservoir where air space exists and continues to a point between the bottom surface of the cap and the upper surface of the gasket lip where an air space exists. The air space between the bottom surface of the cap and the upper surface of the gasket lip communicates with the one or more vent openings in the cap to allow for venting. The gasket has three gasket channels but more or less can exist (e.g., between about 1 gasket channel and between 10 gasket channels) so long as there is communication of air between the reservoir and the space between the cap and gasket lip when the bottle is filled with liquid and inverted. In an embodiment, multiple gasket channels are used to establish an airway regardless of the rotation of the bottle when inverted. The gasket channels can be of any shape or size to facilitate the establishment of such an air passage. The gasket channels can run in any direction (e.g., angled, curved, and the like) so long as the channel establishes the air passage. The gasket channel can have a cross-section that is "U" shaped, but can also be "V" shaped, "C" shaped, an irregular shaped, or any shape.

The gasket lip is positioned at or near the top of the gasket base and forms a flat ring. The lip forms a seal between the upper inside portion of the cap and the cap thread 16, and provides a barrier to the upper reservoir. The lip design prevents leaks from passing through the threads of cap, while the gasket channels allow for air passage.

The gasket can be made from a moldable material and has the ability to compress and decompress to form a seal. Examples of materials that can be used include rubber, silicone, soft plastic, thermoplastic, and the like. The material can be molded with one or more channels in the gasket base and a lip. Any material known or developed in the future can be used to create the gasket so long as the material can be molded with one or more of the elements described herein.

In an embodiment, the gasket, cap and/or nipple can be manufactured using an injection molding process. Briefly, injection molding is a manufacturing process by which a mold is made having the reverse three dimensional conformation of the item to be manufactured. A heated polymer is injection into the mold and allowed to cure or harden. Techniques known in the art or later developed can be used to make the gasket, cap and/or nipple that are described herein.

FIG. 8 shows each piece of the venting baby bottle of the present invention, as described herein, and how they fit together. Accordingly, the present invention includes a venting baby bottle system or kit with one or more of the following: an outer container, an inner container, a gasket, a nipple, and a cap. The system or kit can further include cleaning accessories (e.g., a brush), accessories used to mix baby formula, parts of the bottle (e.g., an additional gasket), or a combination thereof. In an embodiment, the system of the present invention can include a plurality of inner containers that are or can be pre-filled with formula (e.g., powered or liquid formula), breast milk, and any other liquid or powder suitable for an infant. In the case in which the inner container is pre-filled, caps for the top and the bottom to the inner container can be provided.

Figure 9:
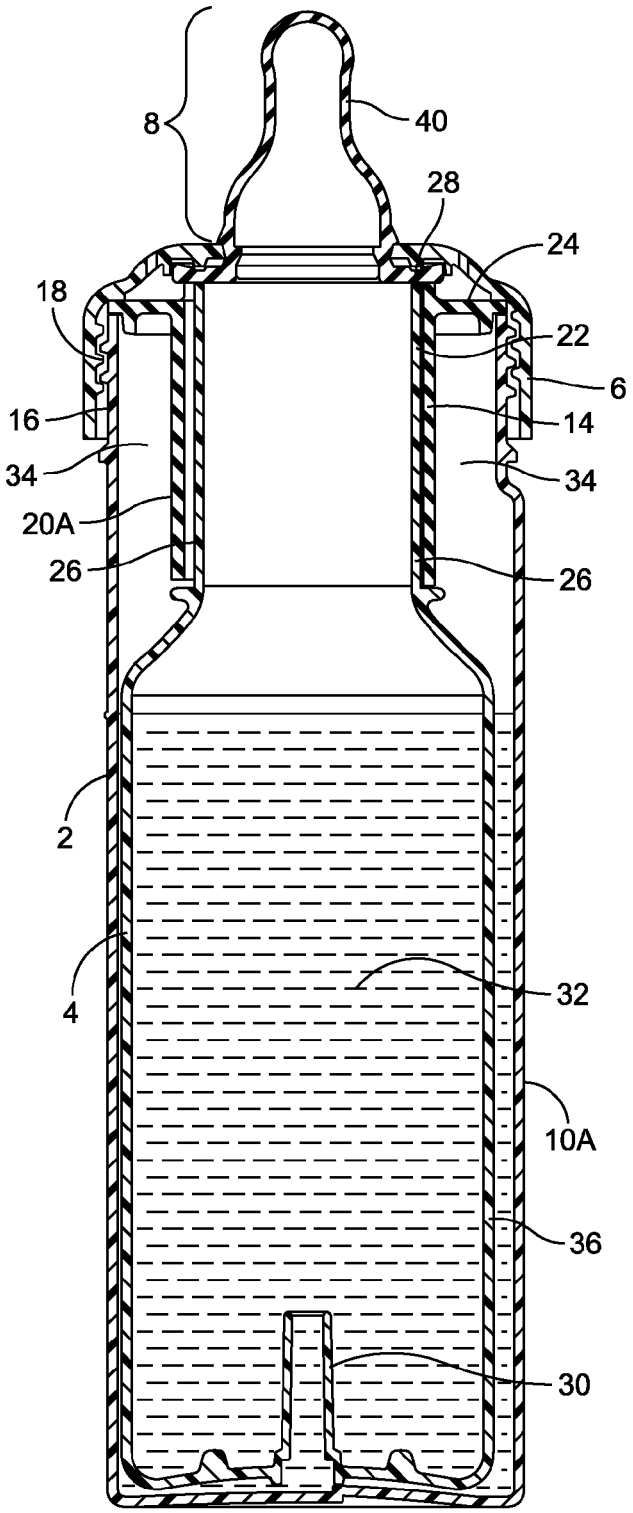
FIG. 9 is a schematic of a cross sectional view of the venting baby bottle of the present invention with liquid therein filled to the fill line in an upright position.

When in use and upright, the venting baby bottle of the present invention is shown, in an embodiment, in FIG. 9. When upright, liquid 32 is filled to the fill line. Both the inner container and the outer container are filled to the same level.

When in use and inverted in the position shown in FIG. 10, liquid 32 flows toward nipple 8. The liquid that was in the space between the inner and outer containers fills a portion of reservoir 34. Liquid 32 in the inner container flows toward the nipple and an air space is created at the bottom of the inner container, near the vent tube. As shown in the figure, the end of vent tube 30 comes into contact with a point in the interior of the inner container where air space exists. However, the end of the vent tube does not need to be in contact with the air inside the inner container because as a vacuum develops in the inner container during use, air from the outside of the bottle displaces the liquid volume consumed to equalize the pressure. The vent tube communicates with the inter-container space. Air from the outside of the bottle can pass to the inside of the bottle to reduce a vacuum or prevent a vacuum from being created. More specifically, air from the outside of the bottle travels through one or more of the vent openings (e.g., vent openings 12A-f) in the cap, passes through the gasket channel into air in the reservoir. The air passage continues along the space between the inner container and the outer container to the vent means (e.g., vent tube 30) to the interior of the inner container. The air passage allows for the air trapped in the baby bottle to be vented properly so that air bubbles are not consumed by the infant.

Accordingly, the present invention encompasses methods of using the venting baby bottle described herein. The method includes filling the bottle in an upright position to the fill line, and securing the cap onto the outer container. The method includes inverting the bottle and placing the nipple in the infant's mouth. Upon use of the bottle, an air passage is established, as described herein. As the infant consumes the liquid, air flows or vents through the air passage to relieve or reduce any vacuum created. The method further includes disassembling the bottle and cleaning the pieces of the bottle.

EXEMPLIFICATION

The venting baby bottle shown in the figures was made. The venting baby bottle was conceptualized and sketched. A prototype was made using Stereolithography (SLA) technology. The prototype was tested and experiments were performed to validate that it works as described herein.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A venting baby bottle, comprising:

a) an outer container having an open top, one or more side channels, wherein the open top is adapted to receive a cap, and wherein the side channel has a volume;

b) an inner container, adapted to fit within the outer container, wherein the inner container has a base, a tapered neck that narrows toward the open top, and a vent at the base of the inner container; and c) a gasket having a gasket base adapted to fit the neck of the inner container, one or more gasket channels, and a lip;

wherein, when the inner container is placed within the outer container, a reservoir is defined between the neck of the inner container and the outer container, wherein the reservoir has a volume, wherein when the venting baby bottle has liquid, is inverted, and is in use, an air passage is established from a point outside the venting baby bottle, through a space between the inner container and the outer container, to a point inside the inner container.

2. The venting baby bottle of claim 1, wherein the volume of the side channels is less than the volume of the reservoir.

3. The venting baby bottle of claim 1, wherein, the vent is a means that comprises a vent tube having an opened end that extends upwardly into the inner container.

4. The venting baby bottle of claim 1, further including a cap adapted to receive a nipple and having one or more vent openings.

5. The venting baby bottle of claim 1, further comprising indicia to indicate a point to which the venting baby bottle is filled with a liquid.

6. The venting baby bottle of claim 5, wherein the indicia is placed on the outer container, inner container when the outer container is transparent or translucent, or both.

7. A venting baby bottle, comprising:

a) an outer container having an open top, wherein the open top is adapted to receive a cap;

b) an inner container, adapted to fit within the outer container, wherein the inner container has a base, a tapered neck that narrows toward the open top, and a vent tube projecting upwardly into the inner container; and c) a gasket having a gasket base adapted to fit the neck of the inner container, one or more gasket channels, and a lip;

wherein, when the inner container is placed within the outer container, a reservoir is defined between the neck of the inner container and the outer container, wherein the reservoir has a volume, and an inter-container space is defined between the outside surface of the base of the inner container and inside surface of the outer container, wherein when the venting baby bottle has liquid, is inverted, and is in use, an air passage is established from a point outside the venting baby bottle, through the inter-container space, to a point inside the container.

8. The venting baby bottle of claim 7, further including a cap with one or more vent openings.

9. A venting baby bottle, comprising:

a) a reservoir defined by a neck of an inner container positioned within an outer container, said inner container having a base with an outer surface, a vent means, and the neck that narrows toward the open top, said outer container having a cylindrical wall with an inner surface, a bottom, and an open top adapted to receive a cap, wherein the reservoir has a reservoir volume; the inner container and the outer container are adapted to have an inter-container space between the outer surface of the inner container base and inner surface of the outer container; the space has an inter-container volume; wherein the reservoir volume is greater than the inter-container volume; wherein, when said venting baby bottle is in an inverted position, in use and has liquid therein, the vent means provides for venting from the inter-container space to a point in the interior of the inner container;

b) a means for preventing the liquid from leaking from the cap; and c) a means for venting air, when the venting baby bottle is in the inverted position, from a point outside of the venting baby bottle to a point within the reservoir;

wherein an air passage is established and communicates from a point outside of the venting baby bottle to a point in the interior of the inner container, wherein the air passage communicates from air outside of the venting baby bottle, through the intra-container space, to the point in the interior of the inner container.

10. The venting baby bottle of claim 9, wherein the means for preventing the liquid from leaking from the cap and the means for venting air from a point within the reservoir both comprise a gasket having a lip and one or more gasket channels.

11. A venting baby bottle system, comprising:

a) one or more outer containers, wherein the outer container has an open top, one or more side channels, wherein the open top is adapted to receive a cap;

b) one or more inner containers, wherein the inner container is adapted to fit within the outer container, and wherein the inner container has a base, a tapered neck that narrows toward the open top, and a vent tube projecting upwardly into the inner container;

c) one or more gaskets, wherein the gasket has a gasket base adapted to fit the neck of the inner container, one or more gasket channels at the gasket base, and a lip;

d) one or more caps, wherein the cap has one or more vent openings adapted to fit the top of the outer container, and a nipple opening, adapted to receive a baby bottle nipple; and e) one or more baby bottle nipples that fit the cap, wherein a combination of one of each of items "a)" through "e)" forms a venting baby bottle, and wherein when the venting baby bottle has liquid, is inverted, and is in use, an air passage is established from a point outside the venting baby bottle, through the inter-container space, to a point inside the container.

12. A method of using the venting baby bottle of claim 1, the steps further comprise:

a) placing liquid therein; and b) allowing an infant to suck from the bottle in an inverted position, thereby establishing an air passage between the air outside of the venting baby bottle and a point inside the inner container.

13. The method of claim 12, wherein air from the outside of the baby bottle displaces liquid consumed by an infant during use.

* * * * *